United States Patent [19]

Brown

[11] 4,350,330

[45] Sep. 21, 1982

[54] BAG UNIT FEEDER

[76] Inventor: Charles K. Brown, 8317 Robert Bruce Dr., Richmond, Va. 23235

[21] Appl. No.: 165,723

[22] Filed: Jul. 3, 1980

[51] Int. Cl.[3] ..... B65H 1/04; B65H 1/26; B65H 3/08

[52] U.S. Cl. ..... 271/12; 271/30 R; 271/149; 271/157; 198/774; 414/118; 414/121

[58] Field of Search ..... 271/30 R, 31, 149, 151, 271/157, 3.1, 11, 12, 10, 13, 14, 15, 147, 158, 159, 162, 164; 198/774, 459; 414/118, 121; 221/11, 103

[56] References Cited

U.S. PATENT DOCUMENTS

| | | | |
|---|---|---|---|
| 3,399,886 | 9/1968 | Brockardt et al. | 271/30 R X |
| 3,705,719 | 12/1972 | Polit et al. | 271/3.1 UX |
| 4,023,667 | 5/1977 | Appel | 414/118 X |
| 4,148,473 | 4/1979 | Johnson | 271/157 X |
| 4,189,136 | 2/1980 | Robinette | 271/157 X |
| 4,223,883 | 9/1980 | Dunn et al. | 271/11 |

*Primary Examiner*—Bruce H. Stoner, Jr.
*Attorney, Agent, or Firm*—Walter G. Finch

[57] ABSTRACT

The invention is an improved bag unit feeder, particularly paper bag units in conjunction with other manufacturing apparatus. The bag unit feeder conveys selected stacks of bag units or bags, or partially manufactured bags, such as bag tubes, in an indexed forward movement and subsequently dispenses them one at a time. The bag unit feeder accepts one of the selected stacks during each indexed forward movement of the conveyor mechanism and then picks up individual bag units, one at a time, from the top of the selected stack and feeds each bag unit automatically to the next operation. The individual bag units are picked up by suction cups with restraining elements of the structure aiding in the process. The restraining elements consist of a novel and unique stabilizing influence of the next succeeding stack of bag units partially overlapping the stack being dispensed, special restraining hold-down rods located adjacent to the suction cups which bend the bag unit as it is picked up, and hook-like fingers near the corners of the leading edge of the bag unit, all of which tend to make the separation of the bag unit from the stack a peeling-type action. This manner of pick up counteracts a tendency of two bag units to cling together. The bag units thus dispensed are fed to the next operation by a conveyors.

15 Claims, 6 Drawing Figures

BAG UNIT FEEDER

BACKGROUND AND SUMMARY OF THE INVENTION

The invention relates generally to equipment for manufacturing paper containers and in particular to equipment for manufacturing paper bags. Specifically, the invention relates to feed mechanisms for feeding bag units or bags or partially manufactured bags, such as bag tubes or tube stock, to a subsequent manufacturing operation.

There are various types of feeding mechanisms in the prior art, some of which relate to the manufacture of paper products. An example in the prior art is U.S. Pat. No. 3,606,306 for which the present inventor was a co-inventor.

In the aforementioned bag feeder of the prior art, a stack of bag tubes is fed on to a ferris wheel type conveyor that elevates the series of stacks of bags to an elevated pick-up mechanism at the top of the machine. The elevated pick-up mechanism then selects one bag at a time and feeds them into a double belt conveyor for a susequent operation. In references herein, the terms "bag unit", "bag", "bag tube", and "bag stock" are interchangeable.

The problems encountered with bag feeders of the prior art are several: the machine operation, because of its inherent operation, is noisy; the "shingling" of stacks of bags on the conveyor are in reverse position and must be lifted at the trailing end in order to put in the next stack; the old method of overlapping stacks requires a longer conveyor system; the old method of overlapping stacks causes problems of stack slippage at the transfer point; bag "tubes" with large pleats are difficult to pick up with a suction system; the machine must operate at a slower speed than the machine's actual capability for moving bags; placing stacks of bags in the vertical type conveyor of the feeder is hazardous, because it is done manually; and other related problems.

In the present invention the aforementioned problems as well as other are eliminated. In the present invention the bag "tubes" may have plain return sides or gusseted sides folded flat, the "tubes" may be single wall or multiwall paper stock, the pick-up mechanism can handle more complex bag "tubes," the top of a packet of bag "tubes" in a stack (called a "hand" in the trade) is maintained at pick-up level for the suction cups and will adjust quickly if a "hand" is smaller than normal size, the "hands" of bag tubes may be loaded directly onto the conveyor more quickly without interference from the prior "hand," the horizontally operating mechanism is quieter than the vertically operating mechanism of the prior art, and the transfer of a "hand" of bag tubes from the conveyor to the feeding mechanism is rapid and positive. There are other advantages of the present invention over the prior art that will be obvious as the details of the invention are described. References herein to "packets of bags", "stacks of bags," and "bulk bags" are interchangeable.

It is to be noted that in the present invention there are three distinct structures for three distinct operations that take plate: an accumulating and indexing means for accumulating a series of stacks of bags and on signal indexing them forward; a receiving and cavity means for receiving a stack of bags indexed forward and maintaining the stack at a level for further dispensing; and a dispensing means for dispensing the bags one at a time for a subsequent operation.

Regarding the aforementioned accumulating and indexing means, there are two major types of structure. One type of structure is a conveyor type, such as a belt conveyor, on which a series of bags can be accumulated in shingle-like arrangement and then indexed forward a predetermined distance so that one stack of bags, the most forward stack, is deposited in the receiving cavity means each time the signal is received to index forward one movement. The other type of structure is a rack type, on which a series of stacks of bags are accumulated in pocket-like rack segments in shingle-like arrangement and then indexed forward a predetermined distance so that one stack of bags, in the most forward pocket-like position, is deposited in the receiving cavity means each time the signal is received to index forward one movement; and in a specified subsequent series of movements the rack is reset so that all other stacks of bags are effectively indexed forward the equivalent of one space.

Regarding the shingling arrangement of bags, in the prior art the shingling was a negative arrangement and in the present invention the shingling is a positive arrangement. In negative shingling, the trailing edge of the last stack of bags on the accumulating and indexing means is lifted, and the leading edge of the stack of bags being loaded on to the accumulating means is shoved under (shingled under) the aforementioned trailing edge of the stack of bags on the accumulating means. In positive shingling, the leading edge of the stack of bags being loaded is simply laid on top of the trailing edge of the preceding stack of bags.

In the conveyor type of accumulating means, and particularly when using negative shingling, the stack of bags have a tendency to slip or slide and become disoriented. In the rack type of accumulating means the aforementiond pocket-like rack segments provide an effective means for maintaining the stack orientation, permits the effective use of positive shingling, and is so configured that a portion of the pocket-like rack segment acts as a "pusher" during the indexing phase.

The rack type accumulating and indexing means and positive shingling is the preferred embodiment.

It is, therefore, an object of the invention to provide a bag feeder mechanism that is easy to load.

It is another object of the invention to provide a bag feeder mechanism that has a positive transfer forward at a high rate of speed to the operating position.

It is also an object of the invention to provide a bag feeder mechanism that will handle flimsy bags readily.

It is still another object of the invention to provide a bag feeder mechanism that will handle pleated or gusseted bags readily.

It is yet another object of the invention to provide a bag feeder mechanism that uses the leading portion of the following "hand" of bag units to hold down the rear or trailing portion of the preceding "hand" on the receiving cavity elevator mechanism while the pick-up mechanism of the dispensing means lifts the leading edge of the bag being dispensed.

It is also another object of the invention to provide a bag feeder mechanism that will prevent waste of the high speed potential of the feeder in relation to the lower speeds of the subsequent operations.

Further objects and advantages of the invention will become more apparent in the light of the following description of the preferred embodiments.

DESCRIPTION OF THE PREFERRED EMBODIMENTS

Figure 2:
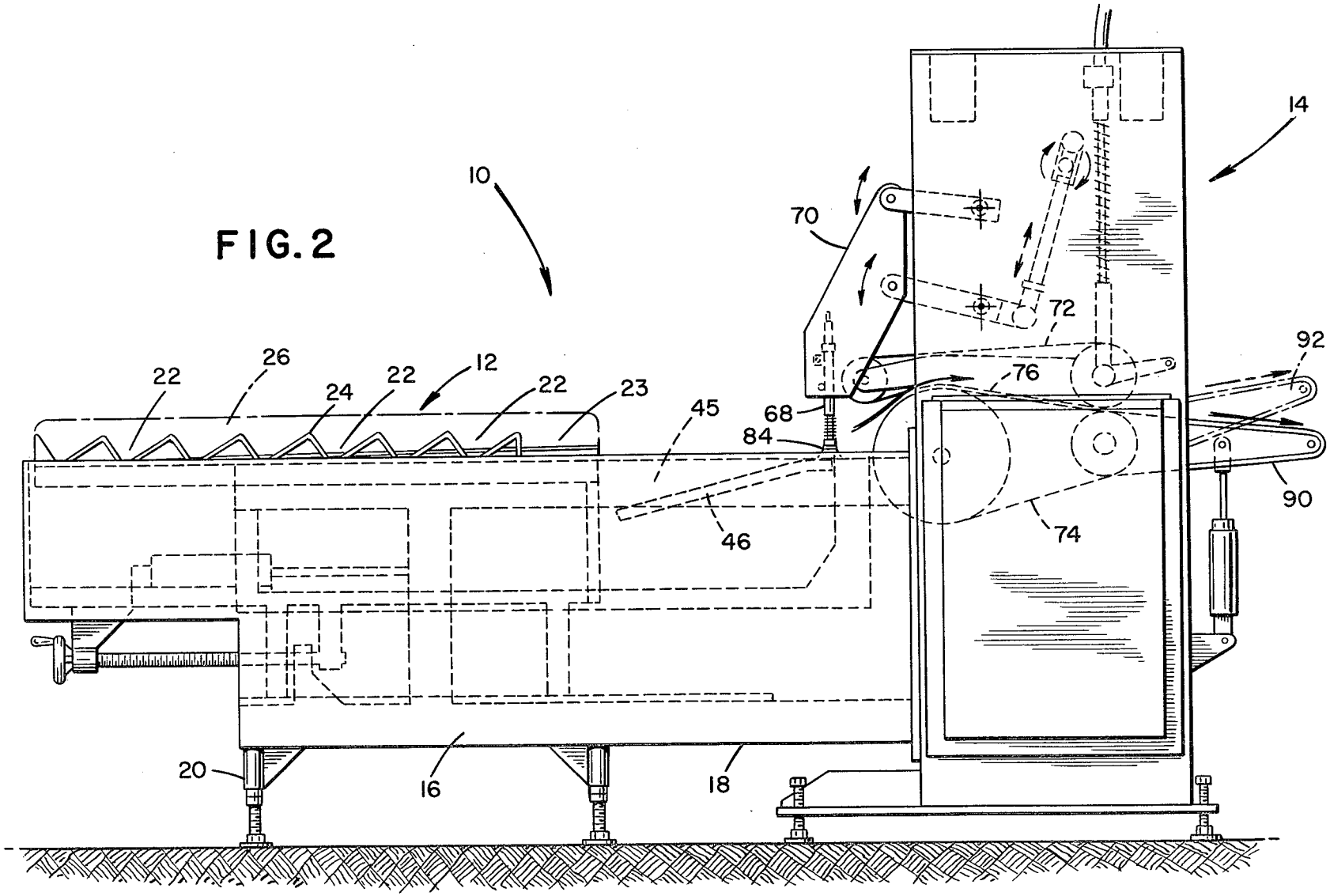
FIG. 2 is a side view of a bag feeder.

Referring to the drawings and particularly to FIG. 2, an improved bag feeder is shown at 10. The bag feeder 10 consists of two major mechanism sub-assemblies or modules, the bulk bag sub-assembly or module 12 and the individual bag dispenser sub-assembly or module 14. These two major mechanism sub-assemblies or modules 12 and 14 that make up the bag feeder 10 are described in detail hereinafter.

Figure 1:
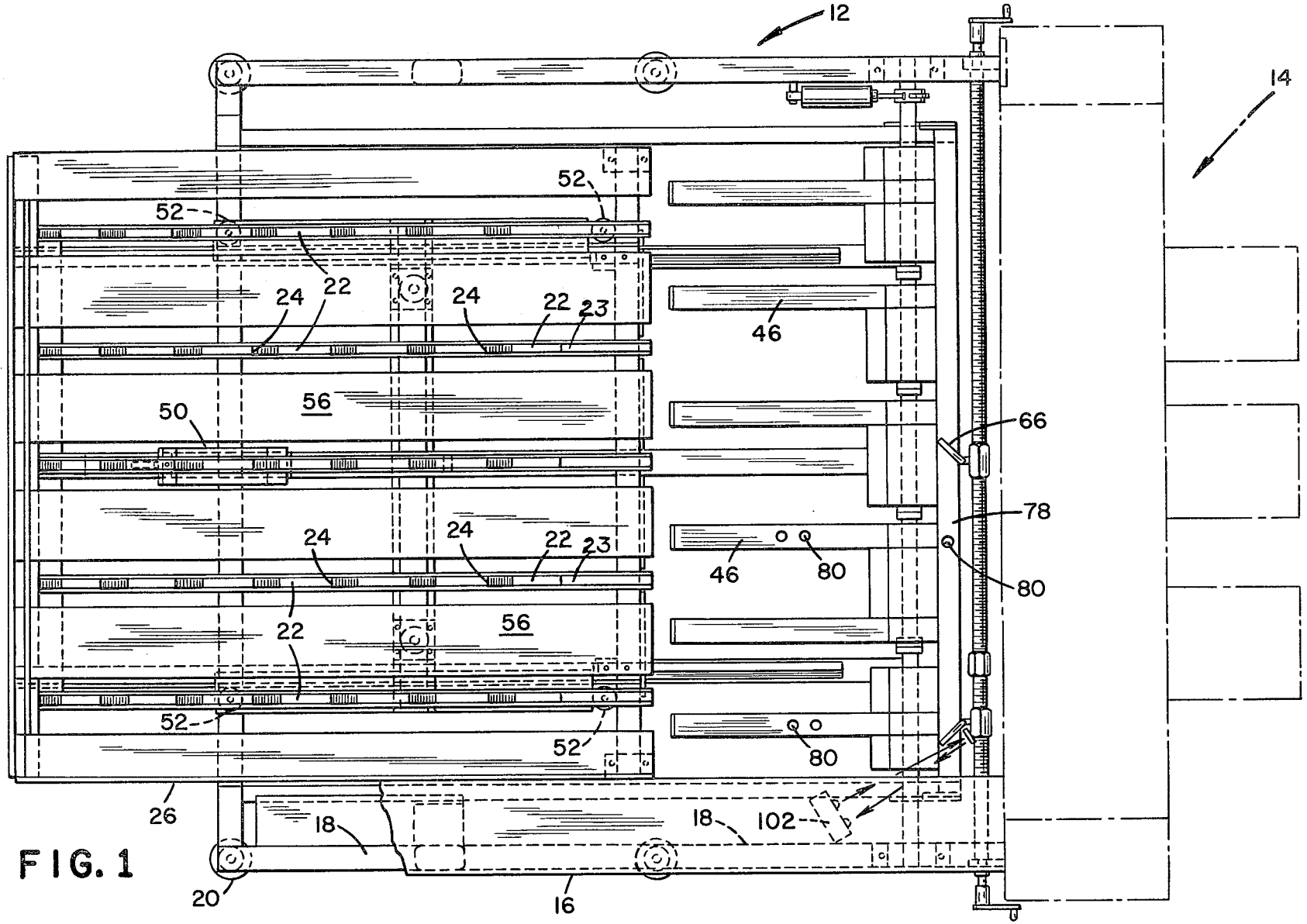
FIG. 1 is a plan view of a bag feeder.
Figure 3:
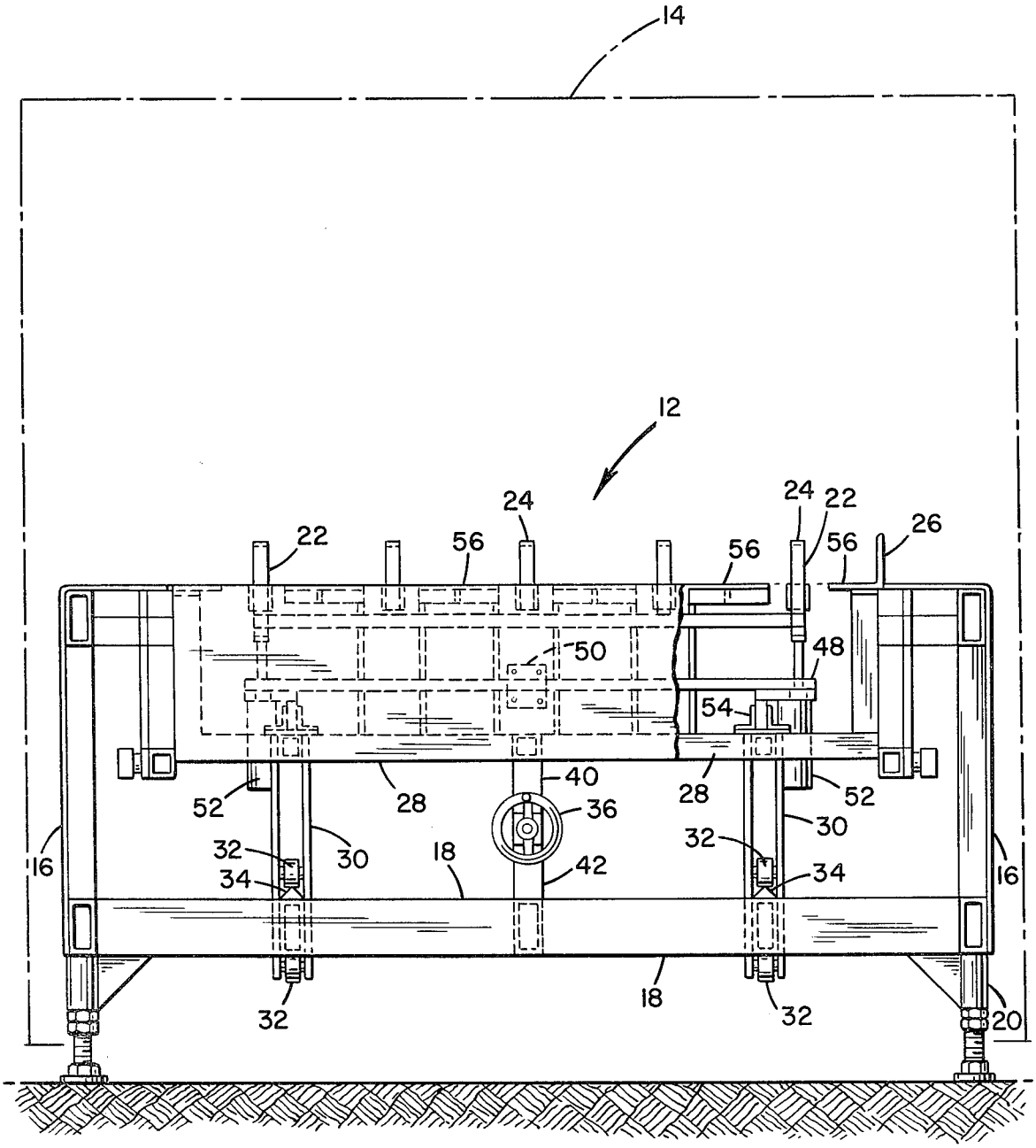
FIG. 3 is a left end view of a bag feeder.

Referring now to FIGS. 1, 2, and 3, the bulk bag sub-assembly 12 will be described first, followed by a description of the individual bag sub-assembly or module 14.

FIG. 2 shows a generalized side view of the bulk bag sub-assembly 12. The main lay-up table portion enclosure 16 encloses the structure of the lay-up table main frame 18. Support legs 20 for the sub-assembly 12 are shown extending below the enclosure 16. Bulk bag sub-assembly 12 contains the accumulating and indexing means and the receiving cavity means as described hereinafter.

Saw tooth like bulk bag pockets 22 at the top hold packets of bags in bulk, each such pocket being referred to as a "hand" of bags in the trade and as used hereinafter. The bulk bag pockets 22 are formed by a plurality of individual saw tooth like pieces 24 connected in series or tandem fashion. It is to be understood that the construction of the total saw tooth like bulk bag pockets in one piece or as an assembly of several pieces is within the scope and intent of this invention. An enclosing plate 26, in the form of an angle as shown, serves as a stop for each "hand" of bags as each "hand" is laid into an individual bulk bag pocket as described later. Note that the last pocket 23 is not of saw tooth configuration, but is ledge-like.

Referring to FIGS. 1 and 3, the enclosing plate 26 can be seen on one side only. As noted hereinbefore, the "hands" of bags (in bulk) when loaded into the individual bulk bag pockets 22, are loaded against the enclosing plate 26 so as to align the ends of the bags as they are later fed into the receiving cavity means 45 for the individual bag feeder sub-assembly 14. The "hands" in the bulk bag pockets 22 is the accumulation, the series of bulk bag pockets 22 is the accumulating means aforementioned.

In FIG. 1, a plan or top view of the bulk bag sub-assembly 12 shows the plurality of bulk bag pockets 22, made up of the plurality of saw tooth like pieces 24, as being in a plurality of spaced apart locations. In FIGS. 1 and 3 seven bulk bag pocket 22 units are shown, it is to be understood, however, that the plurality may be any number with corresponding adjustments in the surrounding structure configuration. As shown, the transverse space across the plurality of bulk bag pocket 22 units provides for a range of bag sizes.

In FIG. 1, only a portion of the enclosure 16 is shown so as to reveal the lay-up table main frame 18 structure. As can be seen in FIGS. 2 and 3, the support legs 20 are adjustable for leveling purposes.

Figure 4:
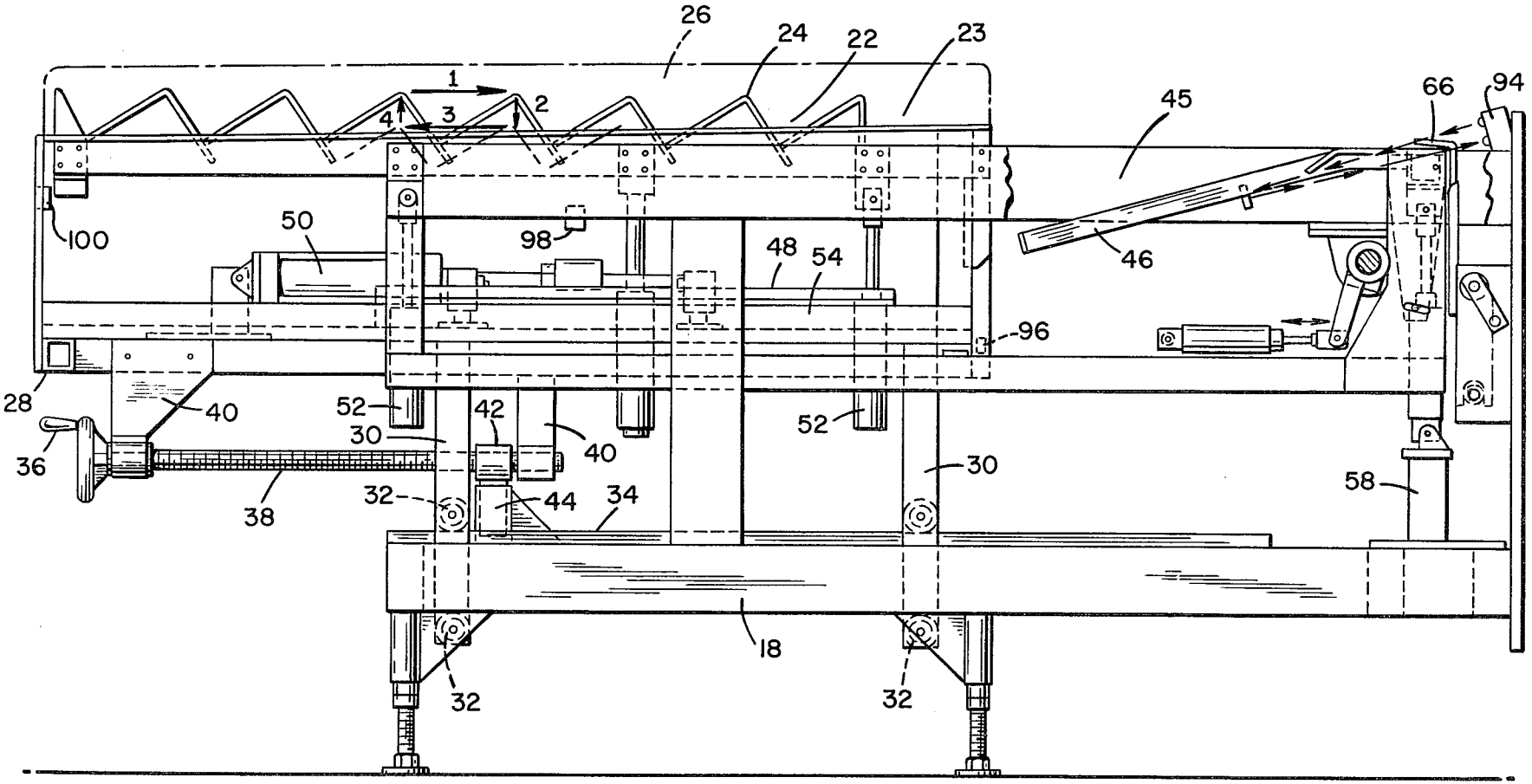
FIG. 4 is a sideview of the framework of a bulk bag feeder sub-assembly module of a bag feeder.

Mounted on the lay-up table main frame 18 is an adjustable positioning frame 28 as seen in FIGS. 3 and 4. Note that FIG. 4 is a side view of FIGS. 1 and 3 with the enclosure 16 removed to reveal the structure of the lay-up table main frame 18 and the adjustable positioning frame 28.

The adjustable positioning frame 28 is carried on leg supports 30 which are movably affixed to and supported by the lay-up table main frame 18. The manner of movably affixing the adjustable positioning frame 28 to the lay-up table main frame 18 is by a plurality of pairs of rollers 32 on leg supports 30. The pairs of rollers 32 movably lock to a longitudinal member 34 of the lay-up table main frame 18. One of rollers 32 of each pair rides on the knife-like top edge of longitudinal member 34 and the other roller 32 of the pair rides along the bottom of the longitudinal member 34 and thus movably locks the pair of rollers 32 to the longitudinal member 34 and movably affixes the adjustable positioning frame 28 to the lay-up table main frame 18.

A hand wheel 36 with threaded shaft 38 affixed to the adjustable positioning frame 28 by supports 40, adjusts and positions the adjustable positioning frame 28 when the threaded shaft 38 is turned through positioning nut 42 mounted 44 on the lay-up table main frame 18. The adjustment and positioning of the adjustable positioning frame 28 is for the purpose of locating the "hands" of bags in the bulk bag pockets 22 and 23 in a position, based on bag size, where they can be properly positioned in a subsequent movement in the receiving cavity means 45, described hereinafter, in preparation for individual bag pick up and feeding to a subsequent operation.

Turning now to FIGS. 1, 2, and 4, a plurality of elevating table fingers 46 are shown in the receiving cavity means 45, between the inboard end of the adjustable positioning frame 28 and the adjacent individual bag feeder 14.

The plurality of elevating table fingers 46, six are shown in FIG. 1, are in the receiving cavity means 45 and receive the "hands" of bags, one "hand" at a time, for the next step of feeding the bags individually to the next subsequent operation. As noted hereinbefore, the adjustable positioning frame 28 is adjusted toward or away from the elevating table fingers 46 in accordance with the bag size to be handled. The last bulk bag pocket 23 just before the receiving cavity means 45 and elevating table fingers 46 must be so positioned so that the bag positioning operation, described hereinafter, will properly position the "hand" of bags in that last bulk bag pocket 23 in the exact required position on the elevating table fingers 46 in the receiving cavity means 45.

In order to move the "hands" of bags in the bulk bag pockets 22 sequentially through the plurality of bulk bag pockets 22 and then finally into the last bulk bag pocket 23 and then from the last bulk bag pocket 23 on to the elevating table fingers 46, a "hand" movement system is provided. The "hand" movement system consists of the assembled plurality of saw tooth like pieces 24 that form the bulk bag pockets 22, a slide frame 48, horizontal movement means, such as air cylinder 50, and a plurality of vertical movement means, such as air cylinders 52.

The components of the "hand" movement system are all assembled within the adjustable positioning frame 28. The slide frame 48 is a framework that supports the assembled plurality of saw tooth like pieces 24 that form the bulk bag pockets 22 and 23. The slide frame 48 slides longitudinally within the slide track 54 which is supported on and within the adjustable positioning frame 28.

As shown, horizontal movement means, air cylinder 50, is anchored to one end of the adjustable positioning frame 28, shown in FIGS. 1, 3, and 4, with the piston rod end of the horizontal movement air cylinder 50 connected to the slide frame 48. Thus, the operation of the horizontal movement air cylidner 50 moves the slide frame 48 (and the bulk bag pockets 22 and 23) in a horizontal direction (forward and backward) with the longitudinal axis of the slide frame 48.

The assembled plurality of saw tooth like pieces 24 that form the bulk bag pockets 22 are affixed to and supported by the slide frame 48 through a plurality of vertical movement means, air cylinders 52 with the piston rods thereof extended. These can be seen in FIGS. 1, 3, and 4. Thus, the operation of the plurality of vertical movement air cylinders 52 moves the bulk bag pockets 22 in a vertically downward and upward direction.

When a sensing system 94, described later herein, senses that there aren't any bags on the elevating table fingers 46, the control mechanism (sensing system 94) signals the horizontal movement air cylinder 50 to operate. The operation moves the slide frame 48 horizontally forward toward the elevating table fingers 46, this moves the "hand" of bags in the last bulk bag pocket 23 directly over and into the receiving cavity means 45 and on to the position of the elevating table fingers 46, thereby dropping the bags into the cavity over fingers 46.

When the horizontal movement air cylinder 50 has pushed the "hand" of bags into the receiving cavity means 45 over the elevating table fingers 46, the control mechanism 96 next signals the plurality of vertical movement air cylinders 52 to operate and the extended piston rods of the vertical movement air cylinders 52 descend or move vertically downward. This latter action completes the positioning of the remaining "hands" of bags in the bulk bag pockets one pocket position forward. This latter action is accomplished by the fact that the prior movement moved them forward one position and the plurality of assembled saw tooth like pieces 24 are so positioned so that on the vertically downward movement in their forward position they pass between the plurality of horizontal surfaces 56, temporarily depositing the "hands" of bags on the surfaces 56 in the one position forward location, as hereinafter described.

In the previous movement, as the piston rods of the vertical movement air cylinders 52 moved downward, the "hands" of bags in the remaining bulk bag pockets come to rest on the horizontal surfaces 56 (beside and between the rows of bulk bag pockets 22) as the bulk bag pockets 22 move below that level.

When the plurality of vertical movement air cylinders 52 reach the downwardmost position, the control mechanism 98 next signals the horizontal movement air cylinder 50 to retract and the entire slide frame 48 is pulled back to its original position, along with the bulk bag pockets 22 which it supports.

When the horizontal movement air cylinder 50 reaches its full retracted position, the control mechanism 100 next signals the plurality of vertical movement air cylinders 52 to operate which extends the piston rods and the bulk bag pockets 22 move vertically upward to their original starting position. As the bulk bag pockets 22 move vertically upward they again interface with or engage the "hands" of bags that were deposited on the horizontal surfaces 56 and the "hands" drop back into the bulk bag pockets. The result is that each "hand" of bags has been indexed one bulk bag pocket forward by the four step cycle movement made by the operation of the horizontal movement air cylinder 50 and the plurality of vertical movement air cylinders 52, including one "hand" now in pocket 23 to move into the receiving cavity means 45 and on to the fingers 46. The four step directional cycle is shown by arrows on FIG. 4.

Directional arrows on FIG. 4 indicated the direction of movement for the aforementioned four-cycle indexing action.

Elevating table fingers 46 are connected to a common support which is affixed to a vertical positioning air cylinder 58. A sensor 102 reads the position of the top bag of the "hand" that is on the elevating table fingers 46 and maintains the level of that bag at the proper elevation for pick up by the individual bag sub-assembly 14 mechanism as hereinafter described.

A "hand" of bags may vary in thickness due to the number of bags in the "hand" (a somewhat arbitrary amount in the trade), or due to the construction of the bags (single-ply versus multi-ply material). When the "hand" of bags is deposited on the elevating table fingers 46, as hereinbefore described, the sensing device automatically signals the control mechanism to operate the vertical positioning air cylinder 58 to bring the top bag to the proper elevation for pick up. As each bag is picked up in turn by the individual bag feeder mechanism, the sensor signals the control mechanism to operate the vertical positioning air cylinder 58 to bring the next bag to the proper elevation for the next pick up.

The indexing upward by the elevating table fingers 46 is rapid so as to always keep a bag at the pick-up level. Also, indexing to the lower position to receive a "hand" of bags is rapid.

When the last bag is picked up from the elevating table fingers 46, a sensor 94 detects the empty elevating table fingers 46 and signals the operating mechanism described hereinbefore to move the next "hand" to the elevating table fingers 46 and position the elevating table fingers 46 at its lower position to receive the "hand" as hereinbefore described.

The reference to sensing devices 94 and 102 hereinbefore refers to photo electric means where it is necessary to detect the existence or non-existence of an article, such as a bag. The reference to control mechanisms 96, 98, and 100 hereinbefore refers to limit switches where mechanical movement of an object must be interrupted, sensed, or signaled for the next movement. These aforementioned sensing devices and limit switches, common in the mechanical and electrical technology art, are suitably located to cause the stated signals to the controls.

Figure 5:
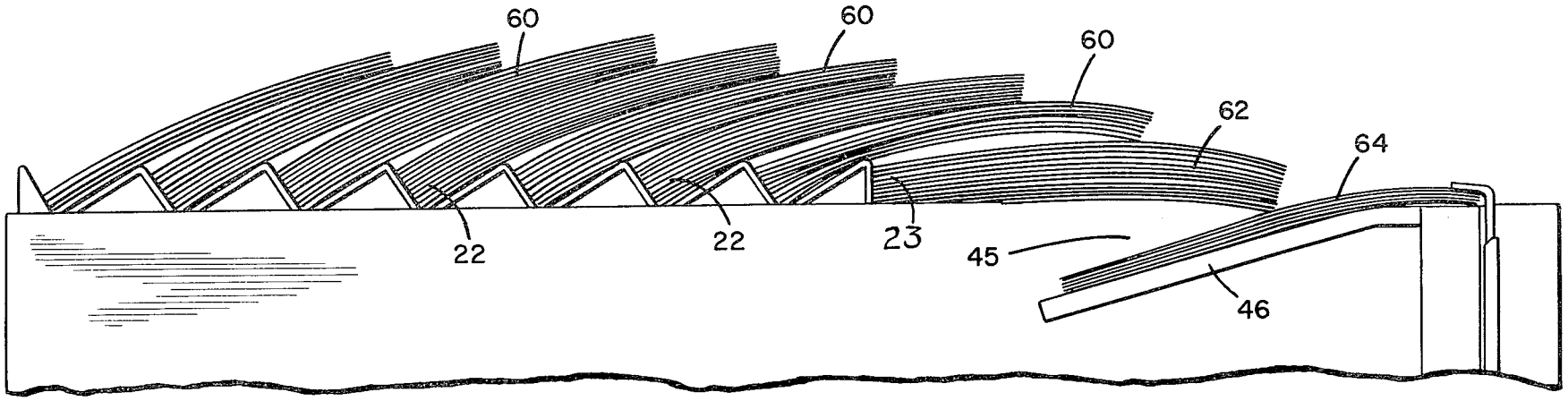
FIG. 5 is a partial view of FIG. 4 pictorially showing bulk packets of bags in bulk bag pockets and on the elevating table fingers.

FIG. 5 is a partial view of FIG. 4 and pictorially shows a "hand" of bags in positive shingle arrangement in each bulk bag pocket 22 and 23, and a partial "hand"

of bags on the elevating table fingers 46. As each "hand" of bags on the elevating table fingers 46 is used the bag feeder mechanism reloads the elevating table fingers 46 as hereinbefore described. As this reloading cycle takes place the "hands" of bags index forward, leaving the first bulk bag pocket 22 empty and ready to have another "hand" of bags placed therein.

Note in FIG. 5 it shows the positive shingling effect of each "hand" of bags 60 upon the next "hand". This is one of the improvements of the present invention over the prior art. In the prior art the shingling was negative or reversed and it was necessary to lift the last "hand" of bags in order to place the next "hand" in the conveyed line. In the present invention, the "hand" of bags is merely placed in the bulk bag pocket and laid on top of the "hand" of bags ahead of it. Each "hand" helps hold the previous "hand" in place.

In a like manner, the "hand" of bags 62 in the last bulk bag pocket 23 holds down a portion of the bag surface of the bags 64 that are on the elevating table fingers 46. This is an improvement over the prior art and is an aid in controlling the subsequent pick-up operation which follows.

The "hands" of bags are placed into the bulk bag pockets 22 with the vertical or longitudinal or long dimension of the bag running across or transverse on the machine, actually lying across two or more rows of bulk bag pockets 22. As seen in FIG. 5, the ends or transverse dimension of the bag is seen on end.

In addition to the hold-down assist performed by the last "hand" of bags 62 in FIG. 5 as hereinbefore described, a pair of hook fingers 66 in FIGS. 1, 4, 5, and 6 are pre-set in location for the size of bag being handled to provide a light hold down at the two exposed corners of the bag. When a new "hand" of bags is deposited on the elevating table fingers 46, the "hand" is automatically brought up under the hook fingers 66 as the elevating table fingers 46 operate to bring the top bag up to the proper elevation. The hook fingers 66 are movably adjustable in a transverse direction so that they can be positioned at the corners of the size bag being handled.

There is one other means of assisting the "hand" or stack of bags to be stable and hold fast on the elevating table fingers 46. The elevating table fingers 46 are hollow, as is the transverse cross piece 78 to which they are affixed. Suction holes 80 in elevating table fingers 46 and its cross piece 78 hold the bag stack stable when a vacuum system is connected to hollow crosspiece 78. The hollow elevating table fingers 46 communicate with the hollow transverse cross piece 78.

The previous description covers the operation of the bulk bag sub-assembly 12 for accumulating and moving "hands" of bags 60 from the supply point to the elevating table fingers 46 by indexing means. This is in preparation for the next operation of the individual bag feeder sub-assembly 14 to pick up individual bags from the "hand" of bags on the elevating table fingers 46 and feed the individual bags to the next subsequent operation.

It is to be understood that this improved bag feeder 10 may be used to feed completed bags for an operation or to feed bag "tubes" (partially completed bags), or any such bag "units", to a subsequent operation, one at a time, for such operations as sewing or gluing one end to make a final bag.

In the aforegoing description of rack-type accumulating and indexing module has been described in detail. It is to be understood that a conveyor-type accumulating and indexing module (not shown), as previously described, could be used instead of the rack-type shown.

Turning now to FIG. 2, the individual bag feeder sub-assembly or module 14 of the improved bag feeder 10 can be seen in its operating position in line with and adjacent to the bulk bag sub-assembly or module 12.

The individual bag feeder sub-assembly or module 14 in FIG. 2 shows a generalized sideview of the mechanism. The principal parts of the individual bag feeder sub-assembly 14 are: a plurality of pick-up arms 68 with a suction cup 84 on each pick-up arm 68; an arc movement mechanism 70; an upper conveyor belt system 72, and a lower conveyor belt system 74.

The operation of the individual bag feeder sub-assembly or module 14 is synchronized with the operation of the next machine operation located downstream. The rate of pick up and bulk bag sub-assembly 12 feeding must be synchronized to match the rate of the machine downstream.

The pick up cycle then proceeds with the bag picked up by the suction cups 84 on the pick up arms 68 being moved in an arc-like path by the arc movement mechanism 70. As the bag being carried by the suction cups 84 on the pick-up arms 68 moves in an arc due to the operation of the arc movement mechanism 70, the leading edge of the bag approaches the moving upper and lower conveyor belt systems 72 and 74 respectively.

The two conveyor belt systems 72 and 74 are turning in opposite directions. As seen in FIG. 2 the upper conveyor belt system 72 is moving in a counter-clockwise direction and the lower conveyor belt system 74 is turning in a clockwise direction. As a result, the conveyor belts of the two systems 72 and 74 are moving in the same direction at their interface 76.

As the aforementioned leading edge of the bag being carried by the suction cups 84 on the pick-up arms 68, and moving in an arc due to the operation of the arc movement mechanism 70, approaches the mouth or throat between the upper and lower conveyor belt systems 72 and 74 where the interface 76 begins, the leading edge of the bag enters the mouth or throat area. As the two conveyor belt systems 72 and 74 take hold of the leading edge of the bag, the suction in the suction cups 84 releases their hold on the bag and the bag is carried along in between the two conveyor belt systems 72 and 74 at the interface 76.

The operation of the suction cups 84 on the pick-up arms 68 is a vacuum or suction system and at the precise moment of release of the bag by the suction cups 84 on the pick-up arms 68, the operation changes from a negative to a positive pressure through the action of a control valve.

Figure 6:
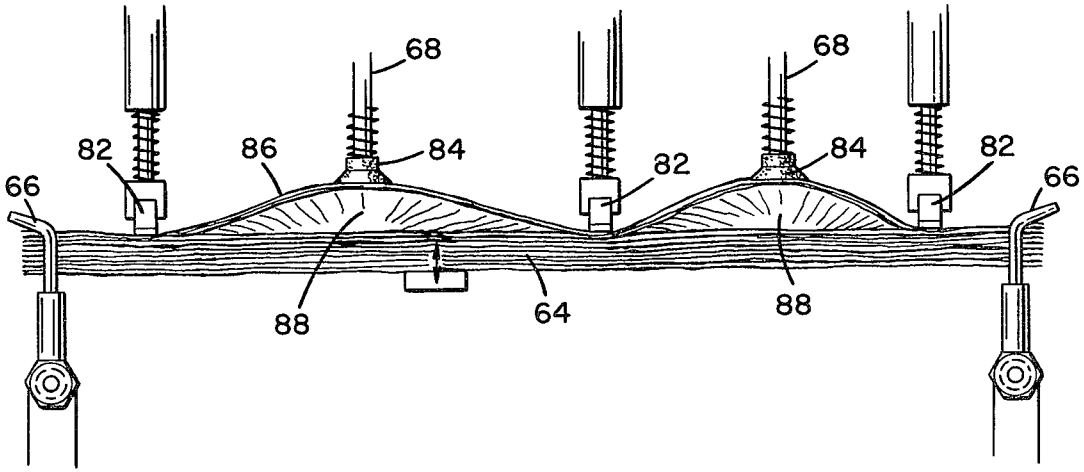
FIG. 6 is a partial pictorial rear view of the pick-up mechanism of an individual bag feeder sub-assembly module of a bag feeder.

Turning now to FIG. 6, a rear view of the pick-up arms 68 shows two such arms. It is to be understood that there may be a plurality of pick-up arms 68 to handle any size bag, each pick-up arm having a suction cup 84 thereon. The pick-up arms 68 may be single arms at a position or more than one arm at a position, such as a pair or a cluster of three (to handle bags of heavy material). Two positions are shown in FIG. 6 with a single pick-up arm 68 at each position for illustrative purposes. Each pick-up arm 68 has a vacuum or suction cup 84 on the bottom to pick up the bag. A bag 86 is shown being picked up by the two suction cups 84 on the pick-up arms 68. The pick-up arms 68 and their suction cups 84 are connected to a vacuum system. The elevating table fingers 46 hold the bags at the proper level to serve the dispenser system.

Also shown in FIG. 6 are hold-down or picker bars or rods, or feet 82. These hold-down rods 82 are synchronized and coordinated with the suction cups 84 and the pick-up arms 68 as hereinafter described.

The hold-down rods 82 are assembled so that the bottom surface of each, which touches the bag, is slightly below the bottom surface of each of the suction cups 84 on the pick-up arms 68. The hold-down rods 82 are spring loaded. A plurality of hold-down rods 82 is used; three are shown in FIG. 6.

As the arc movement mechanism 70 operates to pick up a bag, the hold-down rods 82 descend and touch the bag 86 first and "bottom out". As the operation continues and the pick up arms 68 descend with the suction cups 84, the suction cups 84 are next to touch the bag 86. As the suction cups 84 are descending and touch the bag 86, the springs (not shown) of the hold-down rods compress.

At the precise moment, the suction cups 84 are activated and the bag is picked up at each suction cup point. As the arc movement mechanism 70 begins to lift the pick-up arms 68 the bag 86 is pulled into a broad "M" shape as shown in FIG. 6. It should be kept in mind that the actual shape depends upon the number of pick-up arms 68 and hold-down rods 82 that are in the plurality of arms and rods 68 and 82 respectively for the size of bag being handled.

Assisting the hold-down rods 82 and the suction cups 84 in the proper pick-up of the bag 86 are the aforementioned pair of hook fingers 66 at each rear corner of the bag 86 and the last "hand" of bags 62, in the last bulk bag position 23, that overhangs and rests on part of the "hand" of bags 64 on the elevating table arms 46.

As the arc movement mechanism 70 continues to rise and move in the arc that will carry the bag 86 to the upper and lower conveyor belt system 72 and 74 respectively, the bag 86 is gradually pulled from under the hook fingers 66 and from the "hand" of bags 62. Also, as the arc movement mechanism 70 continues to rise in the arc path, the compressed spring on the hold-down rods 82 decompress so that the hold-down rods 82 continue to hold the bag 86 in the broad "M" shape. Thereafter the pick up arms 68 and the hold-down rods 82 rise in the arc together with the bag 86 held by the suction cups 84. The purpose of the hold-down rods 82 is to prevent the gusset of the bag 86 from opening as the suction cup 84 lifts the bag and opens the spaces 88 under the bag 86. If the gusset of the bag 86 is not held together until the spaces 88 are formed, the natural attraction of bag 86 to the next bag below in the "hand" 62 on the elevating table arms 46 will pull the gusset open or cause multiple feeding of two or more bags.

As mentioned hereinbefore, as the arc movement mechanism carries the bag 86 in arc-like lift, the leading edge of the bag 86 is introduced to the upper and lower conveyor belt system 72 and 74 as previously described. As the suction cups 84 release the bag the pressure therein changes from negative to positive. The lower conveyor belt 74 runs over a relatively large pulley located with its axis on or near the top level of the working surface the "hand" 64 being fed and just clearing the front edge of the stack. If the lower gusset of a bag tends to drop down during the lift the belt movement over the pulley on contact will stabilize the gusset and lift it and carry it along without opening as the contact is made until the bag reaches the throat of the conveyor belt systems 72 and 74.

The conveyor belt systems 72 and 74 operate around drums in directions as hereinbefore described. As the bag 86 conveyed through the conveyor belt systems 72 and 74 at their interface 76 emerges on the far side of the module 14 it is carried forward by a discharge conveyor belt system 90 which conveys it to the next subsequent operation, which may be a conveyor leading to a sewing or gluing operation.

The discharge conveyor belt system 90 is adjustable to a plurality of positions, one of which is shown in phantom lines at 92. This adjustability to a plurality of positions provides a means of taking advantage of the high speed operation of the improved bag feeder 10 which can supply individual bags to a multiple system of subsequent operations that can operate individually at a slower pace than the capability of the improved bag feeder 10. It can also be used in the position 92 to reject a misfeed of more than one bag at a time.

As can be readily understood from the foregoing description of the invention, the present structure can be configured in different modes to provide the ability to feed bags.

Accordingly, modifications and variation to which the invention is susceptible may be practiced without departing from the scope and intent of the appended claims.

What is claimed is:

1. A bag unit feeder, comprising:

an accumulating means, said accumulating means being rack-like, said accumulating means supporting an accumulated series of packets of bag units, each packet of bag units being an accumulation of bag units;

an indexing means, said indexing means being affixed to said accumulating means, said indexing means providing a capability of both lifting said series of packets of bag units enmasse and forwardly advancing said series of packets of bag units one step at a time to a new location in said accumulating means;

a receiving cavity means, said receiving cavity means being located adjacent to said accumulating means and at a lower level than said accumulating means, said receiving cavity means receiving the forwardmost packet of said bag units each time said indexing means advances said series of packets said one step; and a dispensing means, said dispensing means being located adjacent to said receiving cavity means, said dispensing means having a capability of dispensing one single bag unit from said packet of bag units in said receiving cavity means.

2. A bag unit feeder as recited in claim 1, wherein said accumulating means consisting of:

a main framework;

an adjustable positioning framework, said adjustable positioning framework being movably affixed on said main framework;

a slideable framework, said slideable framework being slideably positioned within said adjustable positioning framework;

a rack means, said rack means being positioned at the top of and within said slideable framework, said rack means holding said series of packets of bag units.

3. A bag unit feeder as recited in claim 2, wherein said indexing means consists of:

a plurality of first means for pushing and pulling, said plurality of first means for pushing and pulling being affixed at one end thereof to said slideable framework and being affixed at other end thereof to said rack means, said plurality of first means for pushing and pulling being so arranged to provide a two-way vertical movement of said rack means;

a second means for pushing and pulling, said second means for pushing and pulling being affixed at one end thereof to said adjustable positioning framework and being affixed at other end thereof to said slideable framework, said second means for pushing and pulling being so arranged to provide a two way horizontal movement of said slideable framework; and a control means, said control means being located on said bag feeder unit to signal said first and second means for pushing and pulling when to push and when to pull.

4. A bag unit feeder as recited in claim 3, wherein said control means consists of:

an electrical sensing device, said electrical sensing device being located near said receiving cavity means, said electrical sensing device, sensing that said receiving cavity means is empty, signals said second means for pushing and pulling to push in a horizontally forward movement, said push in a forward movement being the first step of a four step of a replenishment index cycle;

a first mechanical switch device, said first mechanical switch device being located in the path of an element of structure being pushed by said second means for pushing and pulling, said first mechanical switch device being activated by said element of structure at a predetermined movement signals said plurality of first means of pushing and pulling to pull in a vertically downward movement, said vertically downward movement being the second step of four step replenishment index cycle;

a second mechanical switch device, said second mechanical switch device being located in the path of an element of structure being pulled vertically downward by said plurality of first means for pushing and pulling, said second mechanical switch device being activated by said element of structure at a predetermined movement signals said second means for pushing and pulling to pull, thereby horizontally retracting the structure pushed in said first step of said index cycle, said retraction movement being the third step of said four step replenishment index cycle; and a third mechanical switch device, said third mechanical switch device being located in the path of an element of structure being retracted by said second means for pushing and pulling, said third mechanical switch device being activated by said element of structure at a predetermined movement signals said plurality of first means for pushing and pulling means, to push in a vertically upward movement, thereby vertically raising the structure pulled vertically downward in said second indexing cycle, said vertically movement upward being the fourth step of the four step replenishment index cycle for one complete replenishment cycle, thus ending the replenishment index cycle, said structure of said bag unit feeder being in the original starting position and set for the next complete replenishment cycle.

5. A bag unit feeder as recited in claim 3, wherein said receiving cavity means is located at a lower elevation level in relation to the elevation level of said accumulating means to receive and hold a packet of bag units, said receiving cavity means consisting of:

a plurality of elevation finger-like means, said plurality of finger-like means being affixed at one end thereof to a common connecting component;

at least two hook-like finger means, said hook-like finger means being adjustably located and operated in conjunction with said plurality of elevating finger-like means;

a plurality of apertures, said plurality of apertures being located in said plurality of elevating finger-like means and in said common connecting component, said elevating finger-like means and said common connecting component being hollow and communicating therebetween, said apertures are in top surface thereof only and communicates with said hollow interior thereof, said hollow interiors being connected to a vacuum suction system; and a third means for pushing and pulling, said third means for pushing and pulling being affixed at one end to said main frame and being affixed at other end to said plurality of elevating finger-like means affixed to said common connecting component, said third means for pushing and pulling being so arranged to provide a two-way vertical movement of said plurality of elevating finger-like means affixed to said common connecting component, said two-way vertical movement arranged for maintaining a level of said plurality of elevating finger-like means so that the top surface of bag units in said receiving cavity and on said elevating finger-like means is always at a predetermined height for pick up by said dispensing means, said two-way vertical movement arranged to position elevating finger-like means at lowest location when no bag units are in said receiving cavity in order to be in a position to receive bag units.

6. A bag unit feeder as recited in claim 5, wherein said dispensing means consists of:

a plurality of bag unit pick-up means;

a plurality of bag unit hold-down means, said plurality of bag unit hold-down means being located between and adjacent to said plurality of pick-up means;

a plurality of vacuum operated suction cup means, said plurality of suction cup means affixed to said plurality of bag unit pick up means to pick-up individual bag units from bag units on said elevating finger-like means;

an arc movement mechanism, said arc movement mechanism being connected to said plurality of bag component pick up means and said plurality of bag component hold-down means; and a conveyor system, said conveyor system being located at upper end of arc movement of said are movement mechanism.

7. A bag unit feeder as recited in claim 6, wherein said conveyor system consists of:

a first conveyor belt component;

a second conveyor belt component, said first and second conveyor belt moving in a counter-clockwise and a clockwise direction respectively, a portion of said first and second conveyor belt components moving in close proximity of each other as an interface; and a third conveyor belt component, said third conveyor belt component being located at the exit point of said interface of said first and second conveyor belt components, said third conveyor belt component operating so as to deliver individual bag components to a discharge point.

8. A bag unit feeder as recited in claim 5, wherein said first, second, and third means for pushing and pulling is an air cylinder mechanism.

9. A bag unit feeder as recited in claim 2 and additionally, a positioning guide, said positioning guide being located on said adjustable positioning framework and adjacent to an outermost portion of said rack means, said positioning guide serving to align ends of said accumulated stacks of bag units.

10. A bag unit feeder as recited in claim 2 and additionally, a mechanical advantage system to operate said adjustable positioning framework, said mechanical advantage system consisting of a handwheel, a threaded shaft means, and a threaded nut means, said handwheel being affixed to said thread shaft means, said threaded shaft means being affixed to said adjustable positioning framework, and said threaded nut means being affixed to said main framework, said threaded shaft means being threadably inserted into said threaded nut means.

11. A bag unit feeder as recited in claim 2 and additionally, a plurality of horizontal surface means, said plurality of horizontal surface means being located on, and affixed to, top of said adjustable positioning frame, portions of said plurality of horizontal surface means being located between segments of said rack means.

12. A bag unit feeder as recited in claim 2 wherein said rack means consists of a plurality of pocket means, one said pocket means being positioned horizontally and the balance of said plurality of pocket means being positioned at an angle to the horizontal, each said pocket means holding one of said packets of bag units, said pocket means positioned horizontally holding one of said packets of bag units for subsequent movement into said receiving cavity means.

13. A bag unit feeder as recited in claim 7, wherein said first and second conveyor belt components each operate over drum-type means at the beginning and end of said interface, said second conveyor belt components, operating over said drum-type means at the beginning of said interface, being located in close vicinity of and proximity to said packet of bag units on said elevation finger-like means, said second conveyor belt component on contact with each said individual bag unit lifting said bag unit toward and to said interface of said first and second conveyors without the gussets of said bag unit opening.

14. A bag unit feeder as recited in claim 6, wherein said plurality of packets of bag units or said accumulating means are arranged and associated with each other in a positive shingle-like arrangement, said positive shingle-like arrangement positioning the leading edge of each packet of bag units on top of the trailing edge of the packet of bag units forward therefrom, including the leading edge of the most forward packet, said packet of bag units in said receiving cavity being so restrained, together with said hook-like fingers providing restraint for leading edge, provides the necessary conditions for pick-up by said dispensing means.

15. A method for feeding bag units to a subsequent operation downstream, comprising, accumulating a series of packets of bag units, said series of packets of bag units associated with each other in said accumulation in a positive shingled manner, indexing said series of packets of bags in an enmasse lifting and forward movement a precise distance at each index step, dropping the forwardmost packet of bag units in said accumulation of said series of packets of bag units into a lower level position than the level of said accumulation of said series of packets of bag units; said positive shingled manner of association of said accumulation of said series of packets of bag units providing for the leading edge of each said packet of bag units to overlap and partially rest upon the next forwardmost packet of bag units, including the leading edge of the then most forward packet of bag units overlapping and partially resting upon said packet of bag units in said lower level position, said overlapping and resting upon action of the then most forward packet of bag units upon said packet of bag units in said lower level position serving as a partial restraining means for the next subsequent action, dispensing bag units one at a time from the top of said packet of bag units in said lower level position to said next subsequent operation downstream, when last bag unit of said packet of bag units in said lower level position has been dispensed, repeat all said operations by indexing said accumulation of said series of packets of bag units forward so that the then forwardmost packet of bag units drops into said lower level position, and as said accumulation of said series of packets of bag units is indexed forward continue adding to said accumulation of said series of packets of bag units at the trailing end of said accumulation of said series of bag units.

* * * * *